US005988647A

United States Patent [19]

Porter et al.

[11] Patent Number: 5,988,647

[45] Date of Patent: Nov. 23, 1999

[54] BULLET TRAP

[75] Inventors: Jerome L. Porter, Standish, Me.; Charles Embrey, Russell, Pa.

[73] Assignee: Superior Tire and Rubber Corporation, Warren, Pa.

[21] Appl. No.: 09/015,398

[22] Filed: Jan. 29, 1998

Related U.S. Application Data

[60] Provisional application No. 60/036,520, Jan. 29, 1997.

[51] Int. Cl.[6] ..... F41D 1/12

[52] U.S. Cl. ..... 273/410; 89/36.02

[58] Field of Search ..... 273/410; 89/36.02

[56] References Cited

U.S. PATENT DOCUMENTS

| | | | |
|---|---|---|---|
| 1,992,001 | 2/1935 | Caswell | 273/410 |
| 3,197,207 | 7/1965 | Sanzare | 273/410 |
| 4,458,901 | 7/1984 | Wojcinski | 273/410 |
| 4,470,604 | 9/1984 | Hoffmann | 273/410 X |
| 4,819,946 | 4/1989 | Kahler | 273/410 X |
| 4,856,791 | 8/1989 | McQuade | 273/410 |

FOREIGN PATENT DOCUMENTS

| | | | |
|---|---|---|---|
| 4022327 | 1/1992 | Germany | 273/410 |

*Primary Examiner*—William H. Grieb
*Attorney, Agent, or Firm*—Oliff & Berridge, PLC

[57] ABSTRACT

A projectile trap is provided having three groups of suspended polyurethane sheets. The polyurethane sheets are processed so as to have high cut and tear resistance properties and low rebound properties. The hardness of the polyurethane sheets increases from the first group of sheets at the front of the bullet trap, which are first contacted by a bullet, to the third group of polyurethane sheets at the rear of the bullet trap. The polyurethane sheets are suspended in the bullet trap by a keying arrangement which ensures that individual polyurethane sheets of a particular group may only be placed at specific locations in the bullet trap.

27 Claims, 2 Drawing Sheets

BULLET TRAP

This application claims the benefit of provisional application No. 60/036,520 filed Jan. 29, 1997.

BACKGROUND OF THE INVENTION

1. Field of Invention

This invention relates to projectile traps, and in particular to portable traps for target practice to catch and collect spent bullets. More specifically, the invention relates to bullet traps to capture bullets fired from either handguns or rifles at a distance of between 20 to 50 feet from the bullet trap.

2. Description of Related Art

Bullet traps are typically used to capture bullets fired indoors or in enclosed spaces. The bullet traps previously available have generally been large and complicated devices and therefore have been expensive. These bullet traps were often so large and heavy that they required permanent installation. Examples of some prior art bullet traps are shown in U.S. Pat. Nos. 1,992,001; 3,197,207; 4,470,604; and 4,458,901. Thus, it has been difficult for individuals, small police departments and other small organizations to obtain proper equipment for target practice.

In many cases, the limited use that such equipment would receive simply does not justify the cost or the space required to erect a bullet trap. Conventional bullet traps have also tended to produce undesirable lead dust. Conventional bullet traps are also fairly noisy. Finally, bullets fired into conventional bullet traps have on occasion become lost and unrecoverable.

Thus, a portable, relatively lightweight, relatively quiet, bullet trap for indoor use which generates less lead dust and from which more bullets are recoverable is needed.

SUMMARY OF THE INVENTION

This invention provides a bullet trap that is relatively lightweight and quiet. The bullet trap of this invention produces less lead dust than competing designs and permits the recovery of most bullets. The bullet trap of this invention can be used indoors or in an enclosed space.

The bullet trap of this invention includes a metal box having a metal frame with an opening, two sides, a bottom, a top and a back. The bullets are fired towards the opening of the trap. The metal frame supports three groups of polyurethane sheets. The three groups of sheets each includes one to three individual sheets. The largest-area surfaces of the polyurethane sheets are perpendicular to the path of the bullet. The material of the polyurethane sheets is selected to maximize the cut-and-tear properties and to minimize rebound. The polyurethane sheets are suspended from the top of the box. At least the first sheet of the first group of sheets closest to the opening of the trap is fixed at the bottom. The third group of sheets is farthest from the opening of the trap and the second group of sheets is between the first and third groups. The second and third groups of polyurethane sheets are unattached at the bottom. Preferably, the sheets of the first group have a relatively lower hardness and are thinner than the sheets of the other groups. The sheets of the first group are thus relatively easy to penetrate.

The sheets of the second group are preferably of an intermediate hardness and designed to stop intermediate-sized bullets and/or bullets of an intermediate velocity. The sheets of the third group are the hardest and are designed to stop large caliber and/or high velocity bullets.

In a first preferred embodiment of the invention, the top portion of the sides of the bullet trap are keyed to ensure that sheets designed to meet the functional requirements of one group are not mistakenly placed in positions meant for another group. This keying also allows for space between sheets so that spent bullets can drop to the bottom of the bullet trap.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF THE PREFERRED EMBODIMENTS

Figure 1:
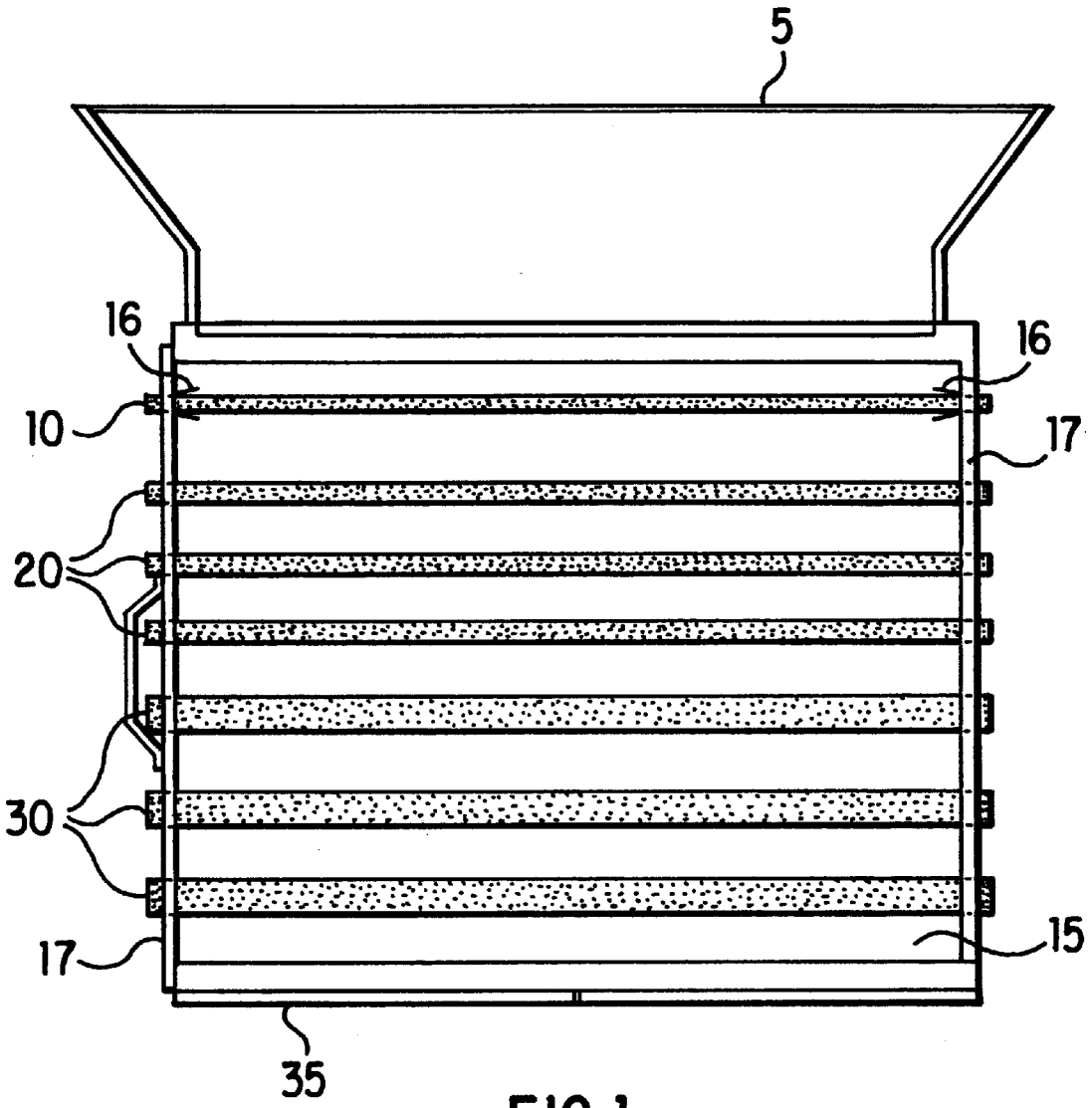
FIG. 1 is a top view of a preferred embodiment of the projectile trap constructed according to the principles of this invention, with the polyurethane sheets keyed to separate the sheets into three unique groups.

As used herein, the term "projectile" means a projectile, such as a bullet or the like, that is fired from a gun or the like. However, the term "projectile" is not necessarily limited to a bullet and encompasses projectiles other than bullets (e.g., buckshot, lead shot, pellets, BB's and the like). Further, the polyurethane sheets referenced herein include, but are not limited to, ester polyurethane sheets and ether polyurethane sheets.

The cut property describes the ability of a polyurethane sheet to resist being torn apart after a cut has been initiated in the sheet. The tear property describes the ability of an uncut polyurethane sheet to resist being pulled apart. High cut-and-tear polyurethane exhibits high resistance to cutting and tearing. The rebound property refers to the ability of a polyurethane sheet to return energy to a bullet impinging upon it. Low rebound polyurethane tends to absorb energy from bullets, thus lessening the rebound of the bullets.

The three groups of polyurethane sheets 10, 20 and 30 have different physical properties to accomplish different functions. The specific physical properties and attributes are described in detail below. The first group 10 includes polyurethane sheets of relatively low hardness which are thinner than the other sheets. The first group of sheets allows all bullets, including those of low caliber and/or velocity, to penetrate the first group of sheets. This avoids bullets rebounding off the first sheet rather than penetrating further into the bullet trap.

The second group of polyurethane sheets 20 stops bullets of the most popular caliber and/or velocity ranges, extending from about 0.22 caliber to about 0.44 caliber and from an impact velocity of at least about 450 ft/sec or about 750 ft/sec, preferably from about 900 ft/sec to about 1,800 ft/sec. The material of this group is preferably a high cut-and-tear, low rebound polyurethane ester. Such a material permits most bullets to pass through one sheet of the second group while dissipating enough energy so that the bullet does not pass through or become embedded in a subsequent sheet of the second or third groups. As a result, bullets passing through one sheet tend to fall to the bottom 55 of the frame 1. The material in the second group of polyurethane sheets 20 is preferably harder and thicker than the material in the first group of sheets 10.

The third group of polyurethane sheets 30 stops the higher caliber and/or higher impact velocity bullets. The material of the third group is preferably also high cut-and-tear, low rebound polyurethane ester. The material of the third group is harder and thicker than the material of the second group. As with the second group, the material of the third group permits most bullets to pass through a sheet while dissipating enough energy so that the bullet does not pass through or become embedded in a subsequent sheet.

FIG. 1 shows a top view of a preferred bullet trap comprising, a first group of one or more polyurethane sheets 10, a second group of one or more polyurethane sheets 20 and a third group of one or more polyurethane sheets 30, each hanging from a top surface 15 of the frame 1. The first group of polyurethane sheets 10 is nearest the opening 5 of the frame 1 and the third group of polyurethane sheets is farthest from the opening 5. As shown in the embodiment of FIG. 1, the second group of polyurethane sheets 20 are positioned between the first group 10 and the third group 30 of polyurethane sheets. In this embodiment, the polyurethane sheets of the first group 10, the second group 20 and the third group 30 are preferably suspended from a top surface 15 of the frame 1. The frame 1 of the embodiment of FIG. 1 also has a back 35.

Figure 2:
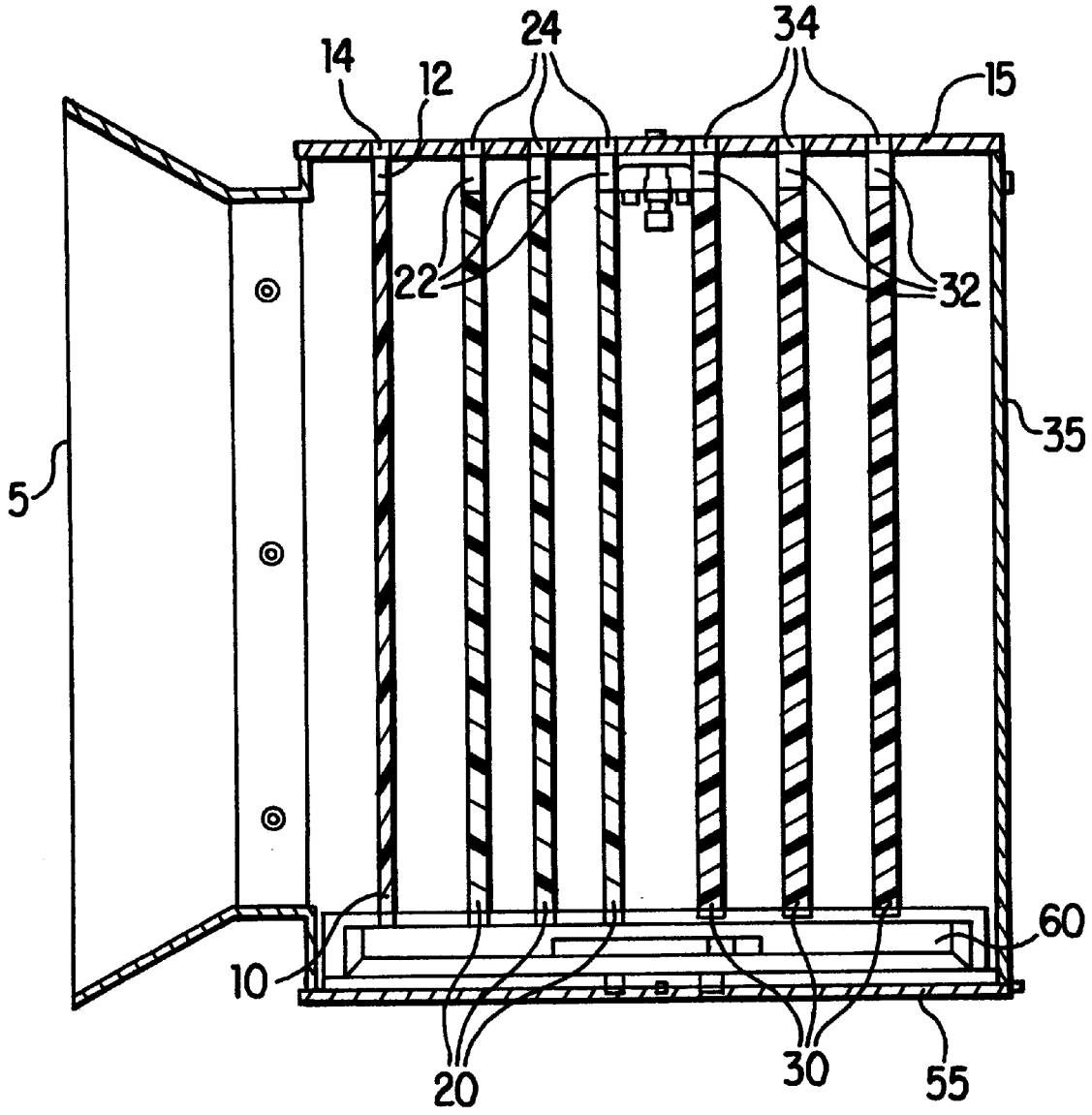
FIG. 2 is a side view of the trap of FIG. 1 depicting polyurethane sheets according to an embodiment of the invention in a typical grouping configuration.

FIG. 2 shows a side view of the sheets as installed, indicating the three groups 10, 20 and 30. Exemplary rods 12, 22 and 32 are attached to the top portions of the first polyurethane sheets 10, the second polyurethane sheets 20 and the third polyurethane sheets 30, respectively. The rods 12, 22 and 32 suspend the polyurethane sheets 10, 20 and 20, respectively, from the top surface 15. The rods 12, 22 and 32 can be attached by any known method to the polyurethane sheets while they are formed. The rods 12, 22 and 32 can be formed of any suitable material.

Preferably, the rods 12, 22 and 32 are of different, mutually exclusive shapes, at least at their ends. The top surface 15 has three groups of notches 14, 24 and 34 having shapes corresponding to the shapes of the rods 12, 22 and 32, respectively. This keying ensures the first, second and third polyurethane sheets 10, 20 and 30 are placed into the frame 1 at the correct locations.

Though not shown in FIGS. 1 and 2, one or more of the polyurethane sheets 10, 20 and 30 may be individually held within a rigid peripheral frame (e.g., a metal frame or a frame of some other rigid material) positioned at the periphery of each such sheet. Any such sheet is held within the peripheral frame to eliminate or substantially minimize the chance the projectile will rebound off the sheet. Alternatively, at least the front most polyurethane sheet 10, when inserted into the frame 1, is held in U-shaped channels 16 provided on either side 17 of the frame 1. This ensures the front most polyurethane sheet 10 will allow the projectile to penetrate through the front most polyurethane sheet 10 into the trap, rather than rebounding from the front most polyurethane sheet 10.

Other methods well known to those skilled in the art may be used to keep the sheets substantially in a planar unfolded configuration. Alternatively, the groups of sheets may each be formed from a single sheet folded upon itself (not shown) to provide a plurality of layers.

The first group of sheets 10 are designed to ensure a bullet penetrates the bullet trap. The frame 1 of the bullet trap uses, in the first group 10, at least one polyurethane sheet, which is positioned at the front of the bullet trap. This at least one sheet is designed to allow a range of bullets, from low caliber and/or low velocity to high caliber and/or high velocity, to pass through the first group. Since it is important that bullets do not rebound off of the sheets of the first group, resilient materials are not used for these sheets. The material selected for the sheets of the first group has a hardness from about 80 shore A durometer to about 87 shore A durometer hardness and is preferably ester polyurethane. The polyurethane is processed to maximize cut-and-tear properties and to reduce rebound properties. The thickness of each sheet of the first group ranges from about 3/16 inch to about 1/4 inch depending on the specific polyurethane selected. The height and width of the sheets is not a factor in performance. Preferably, only the first sheet of the first group is attached at both the top and at the bottom of the trap. This minimizes conversion of a bullet's kinetic energy into movement of the first sheet.

The second group of sheets 20 is designed to maximize the reduction of energy to a bullet impacting the sheets. The second group of sheets is designed to stop the majority of bullets from about 0.22 caliber to about 0.44 caliber bullets and/or bullets having an impact velocity of at most about 1,800 ft/sec. The material selected for the sheets of the second group has a hardness from about 85 shore A durometer to about 93 shore A durometer and is also preferably ester polyurethane. The preferred ester polyurethane is selected due to its thermal plasticity at higher temperatures. That is, ester polyurethane's thermal plasticity allows the polyurethane to expand and deform under the heat generated by the impact of a bullet with the sheet.

Once the bullet exits the polyurethane sheet, the polyurethane partially recovers its original shape. The practical consequence of this effect is that the hole left in the sheet by the passage of the bullet is smaller than the size of the bullet. The polyurethane is selected and processed to maximize cut-and-tear properties and to minimize rebound properties. The thickness of each of the sheets of the second group 20 is from about 1/2 inch to about 5/8 inch. Preferably, the sheets of the second group 20 also all swing freely from the top 15. Preferably, they are suspended at least at a top portion of each side. This allows some of the kinetic energy of the bullets to be dissipated into swinging the sheets.

The sheets of the third group 30 are designed to ensure that the highest caliber and/or the highest velocity bullets are safely stopped. The third group of sheets is designed to stop bullets of up to 405 grains in weight and/or having a velocity of up to 2,500 ft/sec. The material selected for the sheets of the third group has a hardness from about 92 shore A durometer to about 98 shore A durometer and is also preferably ester polyurethane and is selected for the same reasons as outlined above with respect to the second group of sheets. The thickness of each of the sheets of the third group is from about 3/4 inch to about 7/8 inch. The sheets of the third group also swing freely. They are also suspended at the top portion of each side. This again allows some of the kinetic energy of the bullets to be dissipated into swinging these sheets.

Polyurethanes are formed from (1) compounds with isocyanate groups, (2) compounds with backbone ester or ether linkages, and (3) a curative compound. The polyurethanes of the sheets used in the bullet trap of this invention are ester polyurethanes because ester polyurethanes have higher cut-and-tear resistance properties than ether polyurethanes.

In polyurethane processing, two variables are generally controllable: the prepolymer raw material and the stoichiometric ratio of curative compound to prepolymer material.

The prepolymer material contains from about 3 to about 8 mole percent free isocyanate (—NCO) groups. The compound containing the isocyanate groups can be, for example, diphenylmethane diisocyanate ("MDI") including 4,4'-diphenylmethane diisocyanate or toluene diisocyanate ("TDI"). The polyurethane of the first group can be formed from either MDI or TDI. The polyurethane of the second and third groups are preferably formed from MDI.

Hardness is directly proportional to the amount of diisocyanate in a polyurethane. In the present invention, the amount of MDI present in the first group polyurethane is less than in the second group polyurethane, and the amount of MDI in the second group polyurethane is less than in the third group polyurethane. Thus, the third group polyurethane is harder than the second group polyurethane, and the second group polyurethane is harder than the first group polyurethane. That is, the percentage of isocyanate in the third group is at the high end of the isocyanate range, the percentage of isocyanate in the second group is in the middle of the isocyanate range, and the isocyanate percentage of the first group is at the low end of the isocyanate range.

The second general way to control polyurethane is through control of the stoichiometric ratio of curative to prepolymer. A high ratio of curative to prepolymer increases the cut-and-tear resistance of polyurethane and reduces the rebound properties of polyurethane. A curative for MDI is a polyol such as a diol including butanediol, while a curative for TDI is an amine including a polyamine or 4,4-methylylene bis-2-chloramine (MOCA).

According to one embodiment, the bullet trap for catching bullets according to this invention comprises the following features:

(1) a box comprising a bottom, top and a front, back and opposing sides extending from the bottom to the top, the front having an opening for the passage of bullets fired at the trap;

(2) three groups of ester (or ether) polyurethane sheets, each group composed of one to three individual sheets, the polyurethane in each group having been selected for high cut-and-tear resistance properties and low rebound properties appropriate to the function of that group;

(3) means for suspending the sheets from the sides of the trap so that the bottoms of the first group sheets nearest the opening are fixed, while the bottoms of the polyurethane sheets of the second and third groups swing freely;

(4) spacing between sheets sufficient to allow the sheets to swing freely and to allow spent bullets to drop in between the sheets; and (5) a keying structure for suspending the sheets from the sides of the trap that also ensures that an individual sheet, designed according to the function of a particular group of sheets, may only be placed in a location within the bullet trap intended for that particular group of sheets.

While the present invention has been described with reference to specific embodiments, it is not confined to the specific details set forth, but is intended to cover such modifications or changes as may come within the skill in the art.

What is claimed is:

1. A trap that captures a projectile, comprising:

at least one first polyurethane sheet, each first polyurethane sheet having a first suspension device;

at least one second polyurethane sheet, each second polyurethane sheet having a second suspension device;

at least one third polyurethane sheet, each third polyurethane sheet having a third suspension device; and a frame, each of the at least one first, second and third polyurethane sheets suspended from at least a top surface of the frame by the first, second and third suspension devices, respectively, the at least one first sheet suspended at a front portion of the frame, the at least one second sheet suspended at an intermediate portion of the frame and the at least one third sheet suspended at a rear portion of the frame;

wherein at least one of a thickness and a hardness of each at least one third polyurethane sheet is greater than at least one of a thickness and a hardness of each at least one second polyurethane sheet, which is greater than at least one of a thickness and a hardness of each at least one first polyurethane sheet.

2. The trap of claim 1, wherein the second polyurethane sheet is sufficiently spaced apart between the first polyurethane sheet and the third polyurethane sheet to allow the projectile to drop into a bottom portion of the trap.

3. The trap of claim 1, wherein:

the at least one first polyurethane sheet, the at least one second polyurethane sheet and the at least one third polyurethane sheet are respectively positioned within the frame in a direction substantially perpendicular to and in a path of the projectile; and a first one of the at least one first polyurethane sheet is held within the frame so that the projectile penetrates at least the first one of the at least one first polyurethane sheet.

4. The trap of claim 3, wherein the first one of the at least one first polyurethane sheet is held within a first frame attached to the first sheet or within a pair of channels attached to the trap.

5. The trap of claim 1, wherein the first, second and third suspension devices are keyed to corresponding locations along the top surface of the frame.

6. The trap of claim 1, wherein the frame further comprises a front opening allowing the projectile to enter the trap.

7. The trap of claim 1, wherein each first polyurethane sheet has a hardness from about 80 shore A durometer to about 87 shore A durometer and a thickness from about 3/16 inch to about ¼ inch.

8. The trap of claim 1, wherein the at least one second polyurethane sheet together have a hardness and a thickness sufficient to stop the projectile when the projectile is a bullet having a caliber from about 0.22 caliber to 0.44 caliber and having a minimum impact velocity of about 450 feet/second and a maximum impact velocity of about 1,800 feet/second.

9. The trap of claim 1, wherein each second polyurethane sheet has a hardness from about 85 shore A durometer to about 93 shore A durometer and a thickness from about ½ inch to about ⅝ inch.

10. The trap of claim 1, wherein the at least one third polyurethane sheet together have a hardness and a thickness sufficient to stop the projectile when the projectile is a bullet having a weight up to about 405 grains or a velocity of up to about 2,500 feet/second.

11. The trap of claim 1, wherein each third polyurethane sheet has a hardness of from about 92 shore A durometer to about 98 shore A durometer and a thickness from about ¾ inch to about ⅞ inch.

12. The trap of claim 1, wherein the at least one first polyurethane sheet exhibits low hardness, low rebound and is thinner than the at least one second and third polyurethane sheets.

13. The trap of claim 1, wherein the at least one second polyurethane sheet exhibits high cut-and-tear and is harder and thicker than the at least one first polyurethane sheet.

14. The trap of claim 1, wherein the at least one first, second and third polyurethane sheets respectively comprise ester or ether polyurethanes formed by reacting a curative compound and a polyisocyanate.

15. The trap of claim 14, wherein the polyisocyanate reacted to form the at least one first, second and third polyurethane sheets is selected from the group consisting of 4,4'-diphenylmethane diisocyanate, toluene diisocyanate and mixtures thereof.

16. The trap of claim 14, wherein the polyisocyanate reacted to form the at least one second polyurethane sheet is 4,4'-diphenylmethane diisocyanate and the polyisocyanate reacted to form the at least one third polyurethane sheet is toluene diisocyanate.

17. The trap of claim 14, wherein the polyisocyanate comprises a prepolymer further comprising from about 3 to about 8 mole percent free isocyanate (—NCO) groups.

18. A method for trapping a projectile comprising using the trap of claim 1.

19. The trap of claim 1, wherein the thickness and the hardness of each polyurethane sheet of the at least one first polyurethane sheet, the at least one second polyurethane sheet and the at least one third polyurethane sheet are selected such that a projectile having an impact velocity of at least about 450 feet/second on a first one of the at least one first polyurethane sheet penetrates at least the first one of the at least one first polyurethane sheet, while a projectile having an impact velocity of at most about 2,500 feet/second on the first one of the at least one first polyurethane sheet does not penetrate at least one of the at least one third polyurethane sheet.

20. The trap of claim 1, wherein the thickness and the hardness of each polyurethane sheet of the at least one first polyurethane sheet, the at least one second polyurethane sheet and the at least one third polyurethane sheet are selected such that a projectile penetrates at least the first one of the at least one first polyurethane sheet but does not penetrate at least one of the at least one third polyurethane sheet.

21. The trap of claim 1, wherein the thickness and the hardness of each polyurethane sheet of the at least one first polyurethane sheet, the at least one second polyurethane sheet and the at least one third polyurethane sheet are selected such that a projectile can be recovered from the trap.

22. The trap of claim 1, wherein the thickness and the hardness of each at least one third polyurethane sheet are greater than the thickness and the hardness of each at least one second polyurethane sheet, which are greater than the thickness and the hardness of each at least one first polyurethane sheet.

23. A trap that captures a projectile, comprising:

at least one first elastomer sheet, each first elastomer sheet having a first suspension device;

at least one second elastomer sheet, each second elastomer sheet having a second suspension device;

at least one third elastomer sheet, each third elastomer sheet having a third suspension device; and a frame, each of the at least one first, second and third elastomer sheets suspended from at least a top surface of the frame by the first, second and third suspension devices, respectively, the at least one first sheet suspended at a front portion of the frame, the at least one second sheet suspended at an intermediate portion of the frame and the at least one third sheet suspended at a rear portion of the frame;

wherein at least one of a thickness and a hardness of each at least one third elastomer sheet is greater than at least one of a thickness and a hardness of each at least one second elastomer sheet, which is greater than at least one of a thickness and a hardness of each at least one first elastomer sheet.

24. The trap of claim 23, wherein the thickness and the hardness of each polyurethane sheet of the at least one first elastomer sheet, the at least one second elastomer sheet and the at least one third elastomer sheet are selected such that a projectile can be recovered from the trap.

25. A trap that captures a projectile, comprising:

a first group of at least one first elastomer sheet, each first elastomer sheet having a first suspension device;

a second group of at least one second elastomer sheet, each second elastomer sheet having a second suspension device;

a third group of at least one third elastomer sheet, each third elastomer sheet having a third suspension device; and a frame, the first, second and third elastomer sheets suspended from at least a top surface of the frame by the first, second and third suspension devices, each first elastomer sheet suspended in a front portion of the frame, each second elastomer sheet suspended in an intermediate portion of the frame, and each third elastomer sheet suspended in a rear portion of the frame;

wherein at least one of a thickness and a hardness of each elastomer sheet increases between each of the first, second and third groups.

26. The trap of claim 25, wherein the thickness and the hardness of each elastomer sheet increases between each of the first, second and third groups.

27. The trap of claim 25, wherein at least one of the thickness and the hardness of each elastomer sheet increases within each of the first, second, and third groups.

* * * * *